US007559798B2

(12) United States Patent
Ma

(10) Patent No.: US 7,559,798 B2
(45) Date of Patent: Jul. 14, 2009

(54) ELECTRICAL CONNECTOR ASSEMBLY WITH A GROUNDED SHIELD FOR CAMERA MODULE

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/881,928

(22) Filed: Jul. 30, 2007

(65) Prior Publication Data

US 2008/0026626 A1 Jan. 31, 2008

(51) Int. Cl.
*H01R 13/648* (2006.01)

(52) U.S. Cl. ..... 439/607; 439/567

(58) Field of Classification Search ..... 439/567, 439/607; 174/359; 361/359
See application file for complete search history.

(56) References Cited

U.S. PATENT DOCUMENTS 5,508,889 A * 4/1996 Ii ..... 361/816
6,239,359 B1 * 5/2001 Lilienthal et al. ..... 174/370
6,866,544 B1 * 3/2005 Casey et al. ..... 439/607
7,232,316 B2 * 6/2007 Chen ..... 439/71
7,277,301 B2 * 10/2007 Liang ..... 361/816
7,288,003 B2 * 10/2007 Ono et al. ..... 439/607
7,402,082 B2 * 7/2008 Zhang ..... 439/607

* cited by examiner

*Primary Examiner*—Briggitte R Hammond
*Assistant Examiner*—Vanessa Girardi
(74) *Attorney, Agent, or Firm*—Wei Te Chung

(57) ABSTRACT

An electrical connector assembly of the present invention comprises a metal case (4) defining an upper receiving cavity (40) cooperatively formed by four sidewalls upwardly extending from a bottom wall (41) for receiving a camera module (3) therein, and at least one securing member (47) extending from the case (4) for fixing the case (4) onto the printed circuit board (2). The securing member (4) comprises an extending portion (473) extending from the sidewall of the case (4) in a horizontal direction and an inserting portion (471) extending from a free end of the extending portion (473) in a vertical direction for inserting into the printed circuit board (2).

14 Claims, 5 Drawing Sheets

ELECTRICAL CONNECTOR ASSEMBLY WITH A GROUNDED SHIELD FOR CAMERA MODULE

BACKGROUND OF THE INVENTION

1. Field of the Invention

The present invention relates to an electrical connector, and more particularly to an electrical connector used for electrically interconnecting a camera module with a substrate such as a printed circuit board (PCB).

2. Description of the Prior Art

Due to the development of the information and communication technology industry, various types of portable wireless terminals such as mobile phones, Personal Digital Assistant always simply called as PDA and so forth. Said terminals are provided with various functions, for example, e-mail reception and transmission, Internet games and text transmission. Beyond the above basic functions, recently, image communication as a new function is introduced. As a result, said various portable wireless terminals are additionally provided with camera module, correspondingly, electrical connectors are used for connecting with the camera modules are also provided and also disclosed in U.S. Patent Publication No. 2003/0218873.

However, the electrical connectors abovementioned are usually mounted onto the printed circuit board by surface mounting technology (SMT) and the component surface attached by SMT should be plated electroplated layer for mated each other. In addition, the components involved should have smoothly surface and higher coplanar demand. So the connectors manufacture have to spend much time and labor to adjust the coplanar character between components, hence leading to a higher cost and complicate manufacture process. In addition, the connectors are usually mounted on other device via more extra components, which increases the weight of the device and costs too much time.

Thus, there is a need to provide a new electrical connector that overcomes the above-mentioned problems.

SUMMARY OF THE INVENTION

Accordingly, an object of the present invention is to provide an electrical connector used for connecting with a camera module, which has securing members, wherein the securing member is configured to securely and reliably attach the connector assembled the camera module to a printed circuit board.

To fulfill the above-mentioned object, an electrical connector assembly in accordance with a preferred embodiment of the present invention comprises a metal case defining an upper receiving cavity cooperatively formed by four sidewalls upwardly extending from a base portion for receiving a camera module therein, and at least one securing member extending from the case for fixing the case onto the printed circuit board. The securing member comprises an extending portion extending from the sidewall of the case in a horizontal direction and an inserting portion extending from a free end of the extending portion in a vertical direction for inserting into the printed circuit board.

In relative to conventional electrical connectors, the electrical connector of the invention defines at least one securing member which can fix the connector onto the printed circuit board, hence decreasing accuracy of match among between the electrical connector and the printed circuit board, and manufacturing at a lower cost.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
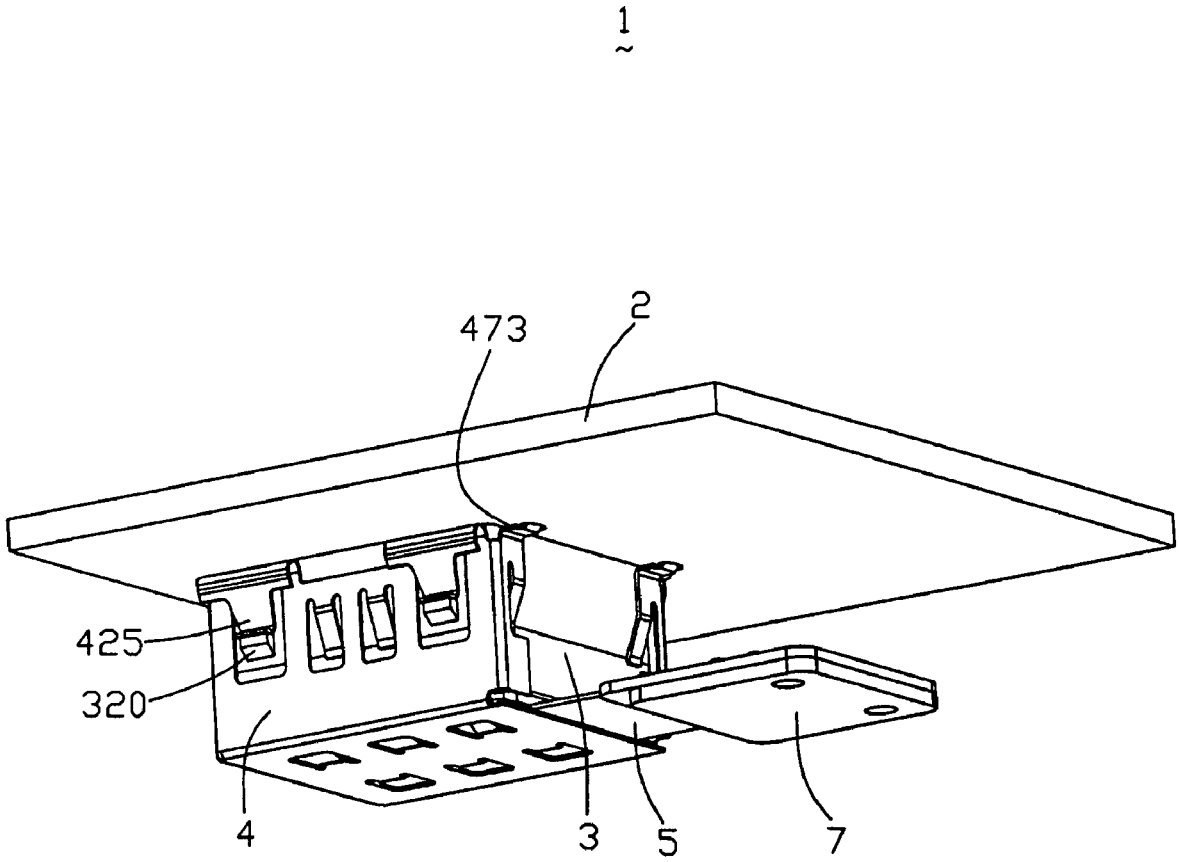
FIG. 1 is an assembled view of an electrical connector in accordance with a preferred embodiment of the present invention.
Figure 2:
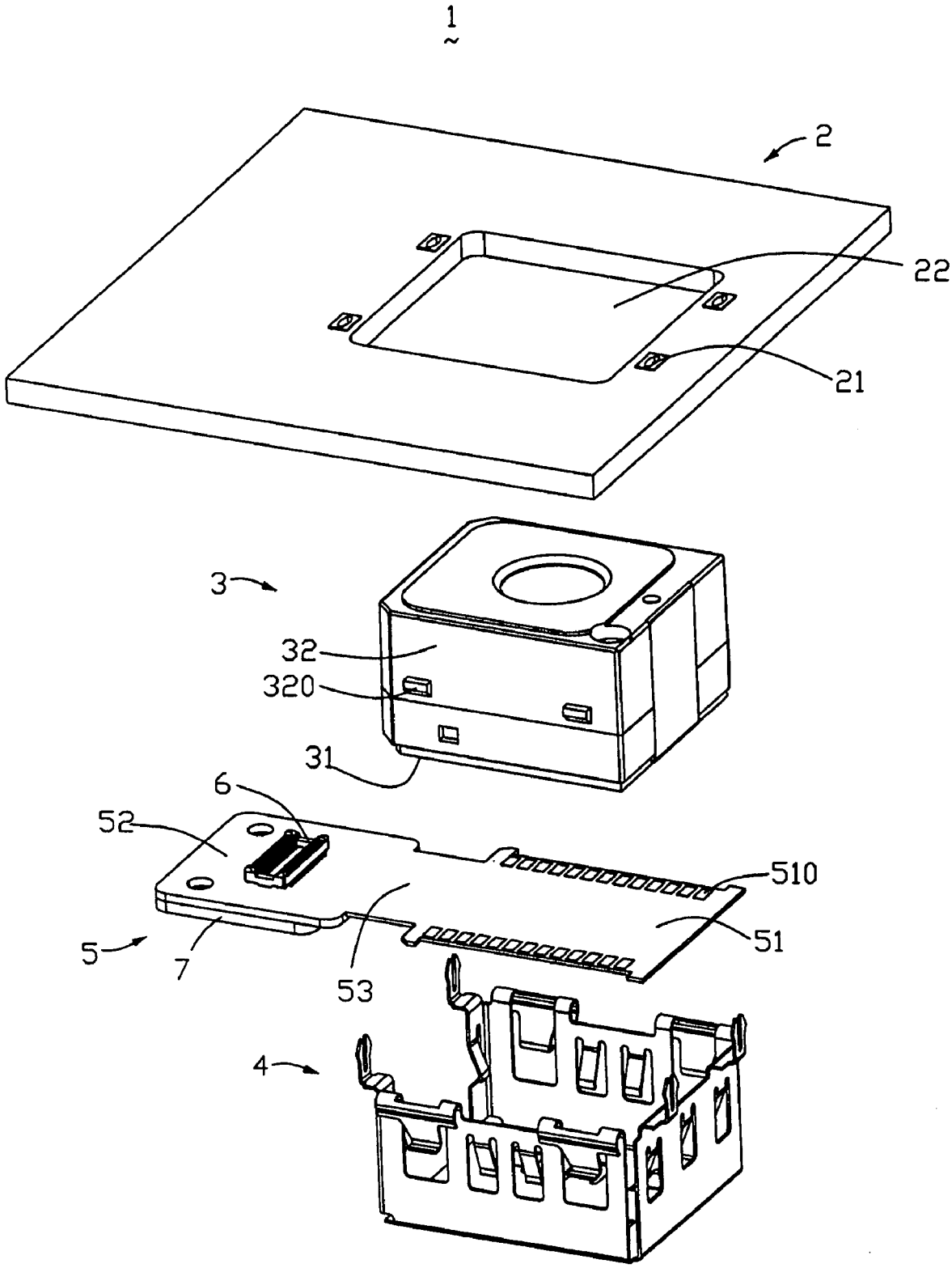
FIG. 2 is an exploded, isometric view of the electrical connector shown in FIG. 1.

Referring to FIGS. 1-2, an electrical connector assembly in accordance with the preferred embodiment of the present invention comprises a camera module 3, a printed circuit board 2, a generally rectangular metal case 4, and a flexible circuit board 5 for bearing the camera module 3 thereon, and a board to board connector 6 attached one end of the flexible circuit board 5, and a reinforce plate 7 attached below the flexible circuit board 5.

Figure 3:
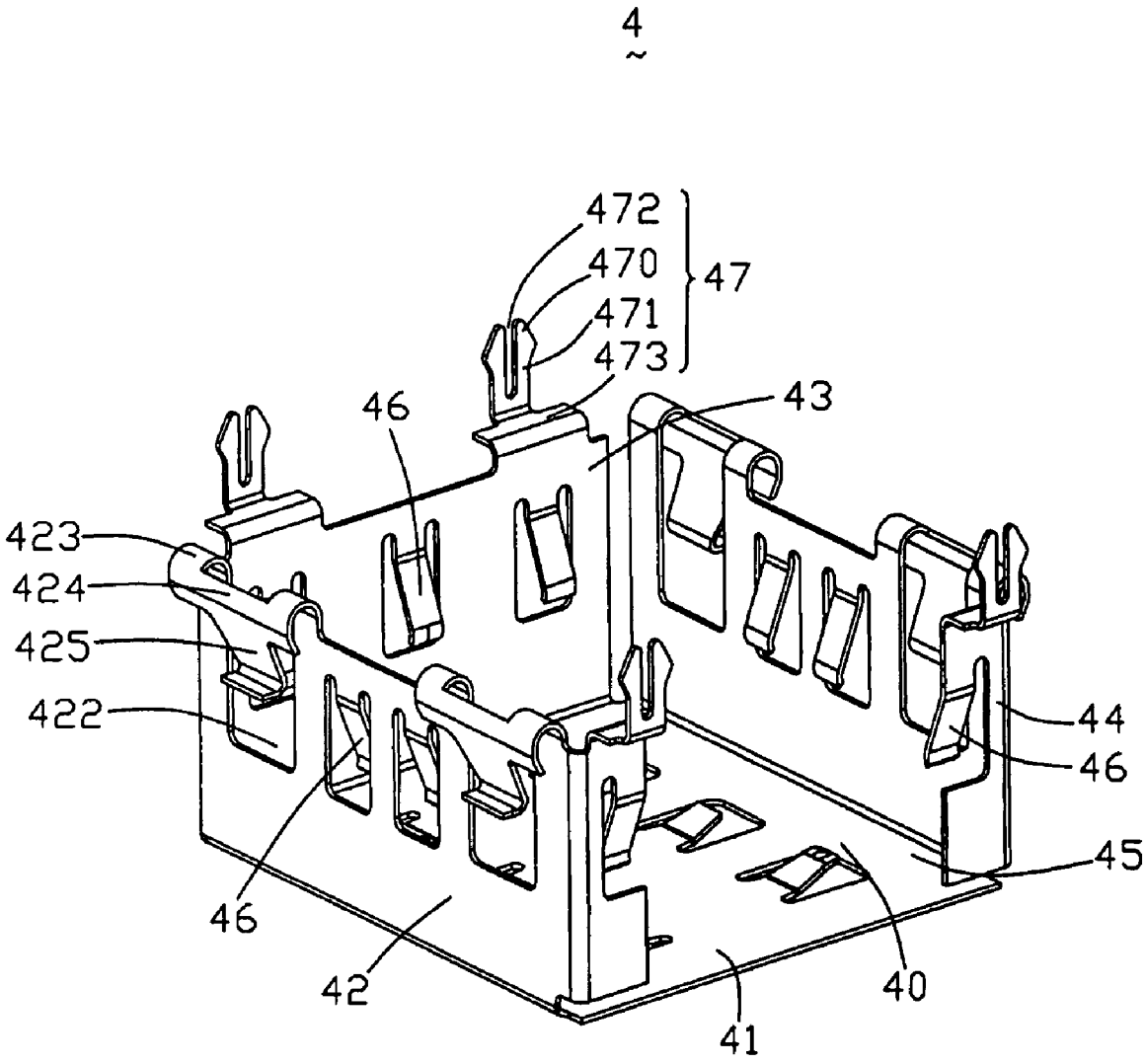
FIG. 3 is a perspective view of the case shown in FIG. 1.

Referring to FIG. 3, the metal case 4 is punched into shape by a metal plate and comprises a first sidewall 43, a pair of opposite second sidewalls 42 connecting with the first sidewall 43, and a pair of third sidewalls 44 connecting with corresponding the second sidewalls 42 respectively and a bottom wall 41 connecting with the first, second and third sidewalls 43, 42, 44. The first, second third sidewalls 43, 42, 44 and the bottom wall 40 are cooperative to provide an upper receiving cavity 40 for receiving the camera module 3 therein. A plurality of elastic pads 46 respectively inwardly and slantly extends from upper positions of the first and second sidewalls 43, 42 for securely engaging with the camera module 3. The case 4 further defines a pair of openings 422 beside the elastic pads 46 of the second sidewalls 42, and a pair of bended arms 423 downwardly extending from an upper end of the second sidewall 42, a bridge portion 424 extending from free ends of the bended arms 423 and connecting the bended arms 423 therebetween, an anchoring portion 425 downwardly extending from the bridge portion 424. The first sidewall 43 defines a plurality of elastic pads 46 spaced each other and extending through the receiving room respectively. The third sidewalls 44 with the bottom wall 41 cooperatively form a receiving slot for receiving the flexible circuit board 5 therein, and each third sidewall 44 defines the elastic pads 46 punched therefrom and extending inwardly for interfering contacting with camera module 3. The first sidewall 43 and third sidewall 44 each define a pair of securing members 47 each comprising a planar body 473 horizontally extending from the corresponding sidewall and an inserting portion. The inserting portion comprises a locking portion 471 upwardly extending from the planar body 473, and a pair of leading portions 470 extending from an upper end of the locking portion 471 and spaced each other, and a channel 472 formed between the leading portions 470. The leading portion 470 is configured as triangle shape and the locking portion 471 is formed as a descending size in a top to bottom direction. The widest portion of the locking portion 471 is an adjoining position between the leading portion 470 and the locking portion 471. The leading portion 470, the locking portion 471 and the channel 472 cooperatively form an inserting portion for inserting into the printed circuit board 2.

Referring to FIG. 2, the printed circuit board 2 defines a concave 22 for receiving the camera module 3 therein, a number of passageways 21 for receiving the securing portion 47 therein, the passageways 21 are plated with conducive materials, which makes the securing member inserted therein have conductive earth effect.

The camera module 3 is in a rectangular shape and comprises a pair of projections 320 extending from front and rear sidewalls, when the camera module is mounted into the receiving room 40 of the case 4, the anchoring portion 425 of the case is abutting against the projections 320 which prevent the camera module 3 from escaping off. In addition, the camera module 3 defines a number of conductive points on a bottom thereof. The flexible circuit board 5 comprises a first end 51 and second end 52, and a connecting portion 53 connecting the first end 51 with the second end 52. The first end 51 and the second end 52 define a same width, which is wider than that of the connecting portion 53. The first end 51 defines a number of conductive pads 510 corresponding to the pads of the camera module 3. When the camera module 3 is soldered to the first end 51 of the flexible circuit board 5 and then both are received into the receiving room 40 of the case 4, the first end 51 is sandwiched by the camera module 3 and the bottom wall 41 of the case 4. Then the board-to-board connector 6 is soldered to an upper surface of the second end 52, in addition, the reinforce plate 7 is attached below the flexible circuit board 5 to get a strengthened structure.

Figure 4:
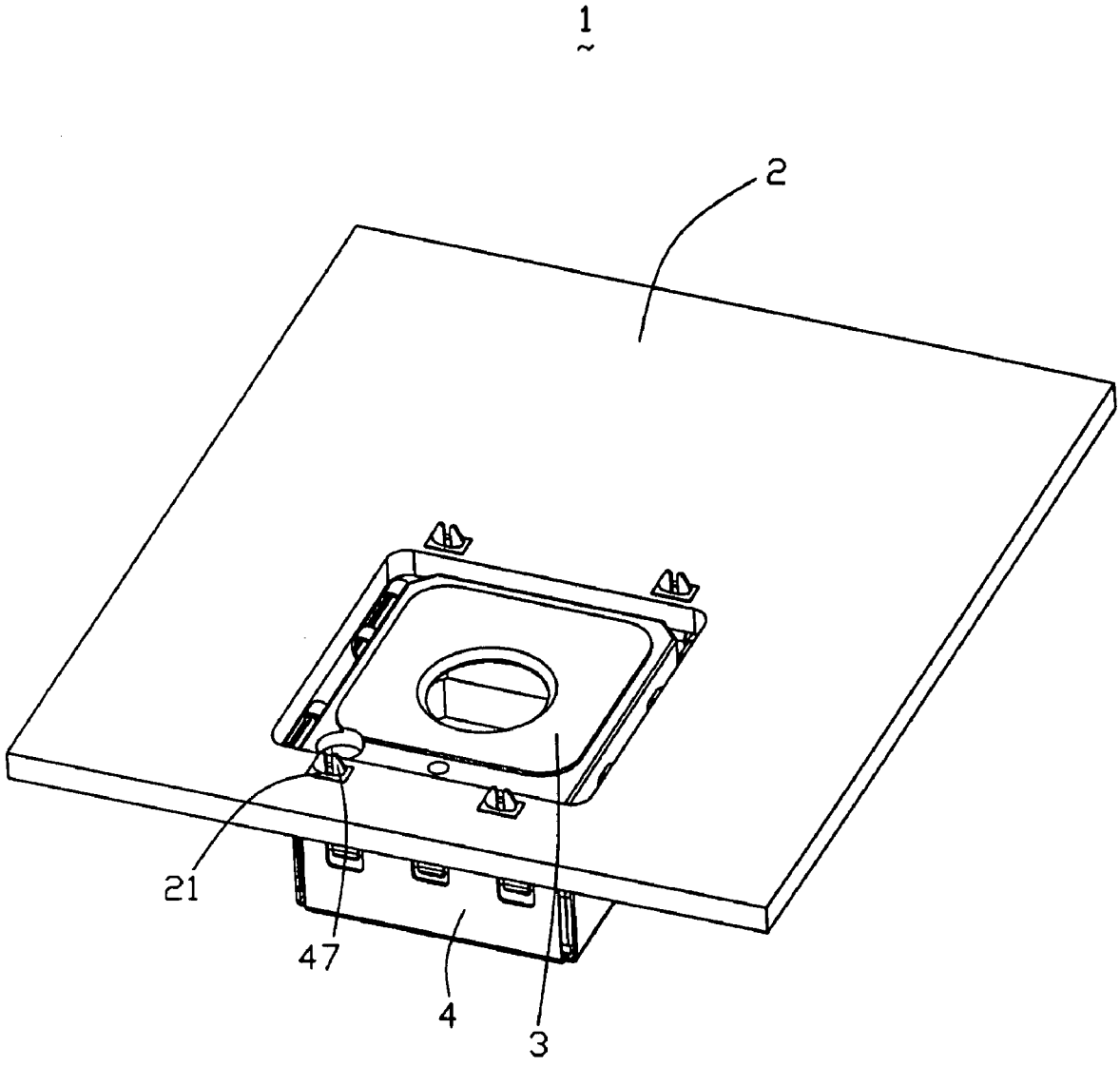
FIG. 4 is a bottom view of the electrical connector shown in FIG. 1.
Figure 5:
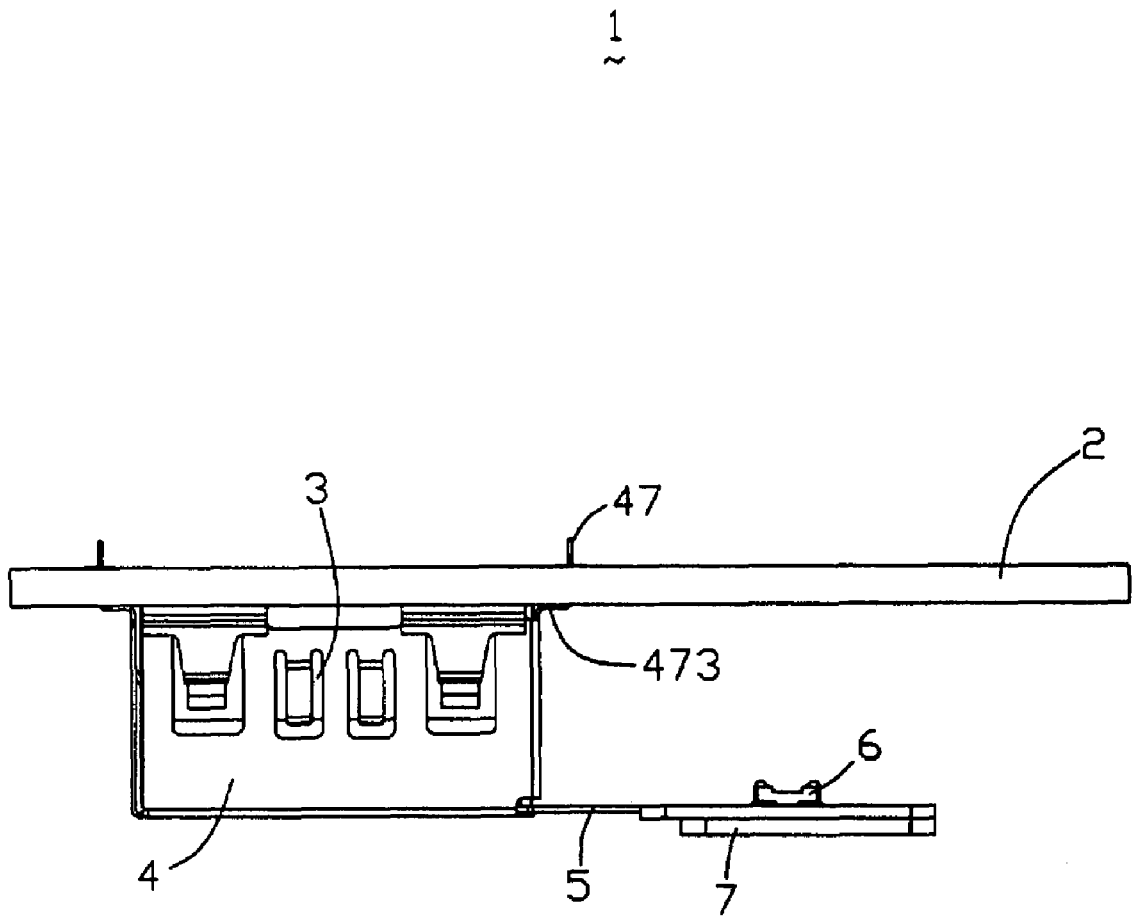
FIG. 5 is a side view of the electrical connector shown in FIG. 1.

Referring to FIGS. 4-5, in assembly, the camera module 3 is firstly electrically mounted onto the first end 51 of the flexible circuit board 5, then the camera module 3 attached with the flexible circuit board 5 is inserted into the receiving room 40 of the case 4 in an upper-to-bottom direction, wherein a lower surface of the anchoring portion 425 of the case 4 is abutting against an upper surface of the projection 320, and the elastic pads 46 interfering engaging with sidewalls of the camera module 3. The opening 45 of the third sidewall is defined just enough for the connecting portion 53 of the flexible circuit board 5 passing through, and the first end 51 of the flexible circuit board 5 is enveloped by the first sidewall 43, the second sidewalls 42 and the third sidewalls 44 rightly. Then the camera module 3 with the first end 51 of the flexible circuit board 5 is assembled to the receiving room 40 of the case 4. Successively, the board to board connector 6 is mounted on the upper surface of the flexible circuit board 5, the reinforce plate 6 is attached below the second end 52 of the flexible circuit board 5, then the case 4 assembled the flexible circuit board 5 with the board to board connector 6 and the camera module 3 all mounted on to the printed circuit board 2 with securing portion 47 of the case 4 inserted into the passageways 21 of the printed circuit board 2. At the moment, the electrical connector assemble 1 are assembled. In addition, the securing portion 47 and passageways 21 can be plated solder plate for getting a tight engagement.

The case 4 assembled the camera module 3 is attached to the printed circuit board 2 by the securing portions 47, hence decreasing the accuracy of mate between the components and cost used thereof. In addition, the passageways 21 can be plated conductive materials, and the conductive earth effect realized by the engagement between the locking portion 471 and the passageways 21 cooperatively provides a static electricity screening effect.

The leading portions 470 defined on the securing portions 47 make the metal case 4 easily insert into the passageways 21 of the printed circuit board 2 and the channel 472 between the leading portions 470 can provide a good flexibility thereof and the planar portion 473 can provide a good engagement between the metal case 4 and the printed circuit board 2.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly adapted for connecting a camera module to a printed circuit board, comprising:

a case defining four sidewalls, a bottom wall and a cavity cooperatively formed by the sidewalls and the bottom wall for receiving the camera module, at least one sidewall of the four sidewalls extending at least one securing member for securely attaching the case, which is associated with the camera module, to the printed circuit board; wherein the case further comprises at least one opening on one sidewall, and at least one bended arm outwardly extending from a top end adjacent the opening of the sidewall.

2. The electrical connector assembly according to claim 1, wherein the case further defines at least one opening on sidewalls, a pair of bended arms extending from a top end of the sidewall adjacent to the opening, and a bridge portion connecting two free ends of the bended arms and an anchoring portion extending from the bridge portion through the corresponding opening for interfering engaging with a projection disposed on the camera module to securely assemble the camera into the case.

3. The electrical connector assembly according to claim 1, wherein the each securing member comprises a planar portion independently bended and horizontally extending from a top end of the sidewall directly, and an inserting portion uprightly extending from the planar portion, said planar portion has one end reaching to an edge of the cavity.

4. The electrical connector assembly according to claim 3, wherein the inserting portion comprises a locking portion and a leading portion extending from the inserting portion configured into a triangle shape.

5. The electrical connector assembly according to claim 4, wherein the securing portion defines a channel on a top end of the leading portion for dividing the leading portion into two parts.

6. The electrical connector assembly according to claim 3, wherein the printed circuit board defines a number of passageways corresponding to the at least one securing member for receiving the at least one securing member therein.

7. The electrical connector assembly according to claim 6, wherein the passageways are plated metallic electrical coatings for providing a conductive earth effect to the securing member being inserted into.

8. The electrical connector assembly according to claim 7, wherein the locking portion is engaging with the passageway through welded joint.

9. The electrical connector assembly according to claim 7, wherein the printed circuit board defines a through mounting hole for receiving the camera therein.

10. An electrical connector assembly comprising:

a printed circuit board defining opposite upward and downward faces thereon;

a metallic case defining a receiving cavity therein and an opening through which a camera module is located into the receiving cavity, said case further including a support plate opposite to said opening; and the case and the printed circuit board being configured to only allow the case to be assembled to the printed circuit board in an upward direction; wherein a camera module is downwardly loaded into and retained in the receiving cavity and upwardly supported by the support plate.

11. The electrical connector assembly as claimed in claim 10, wherein a flexible printed circuit board is sandwiched between the support plate and the camera module.

12. The electrical connector assembly as claimed in claim 10, wherein the whole case is completely under the downward face of the printed circuit board.

13. The electrical connector assembly as claimed in claim 10, wherein said printed circuit board defines a through opening in alignment with the receiving cavity, and said through opening is dimensioned to be large enough to allow the camera module to pass therethrough for being downwardly loaded into the receiving cavity.

14. The electrical connector assembly as claimed in claim 13, wherein no portions of the case are located in said through opening.

* * * * *